US007980313B2

(12) United States Patent
Barbee, Jr.

(10) Patent No.: US 7,980,313 B2
(45) Date of Patent: Jul. 19, 2011

(54) METHOD AND APPARATUS FOR CATCHING A PUMP-DOWN PLUG OR BALL

(75) Inventor: John Phillip Barbee, Jr., Gretna, LA (US)

(73) Assignee: Gulfstream Services, Inc., Houma, LA (US)

( * ) Notice: Subject to any disclaimer, the term of this patent is extended or adjusted under 35 U.S.C. 154(b) by 143 days.

(21) Appl. No.: 12/168,651

(22) Filed: Jul. 7, 2008

(65) Prior Publication Data

US 2009/0008098 A1 Jan. 8, 2009

Related U.S. Application Data

(60) Provisional application No. 60/948,057, filed on Jul. 5, 2007.

(51) Int. Cl.
*E21B 34/00* (2006.01)
*E21B 34/06* (2006.01)

(52) U.S. Cl. ..... 166/325; 166/373

(58) Field of Classification Search ..... 166/318, 166/329, 162, 99, 383, 77, 374, 153, 156, 166/291
See application file for complete search history.

(56) References Cited

U.S. PATENT DOCUMENTS

| | | | | |
|---|---|---|---|---|
| 2,924,237 | A * | 2/1960 | Ellis | 137/599.18 |
| 3,713,490 | A * | 1/1973 | Watson | 166/305.1 |
| 3,828,852 | A | 8/1974 | Delano | |
| 4,427,065 | A | 1/1984 | Watson | |
| 4,624,312 | A | 11/1986 | McMullin | |
| 4,671,353 | A | 6/1987 | Daming | |
| 4,722,389 | A | 2/1988 | Arnold | |
| 4,782,894 | A | 11/1988 | LaFleur | |
| 4,854,383 | A | 8/1989 | Arnold et al. | |
| 4,995,457 | A | 2/1991 | Baldridge | |
| 5,095,988 | A | 3/1992 | Bode | |
| 5,236,035 | A | 8/1993 | Brisco et al. | |
| 5,293,933 | A | 3/1994 | Brisco | |
| 5,435,390 | A | 7/1995 | Baugh et al. | |
| 5,758,726 | A | 6/1998 | Streich et al. | |
| 5,833,002 | A | 11/1998 | Holcombe | |
| 5,856,790 | A | 1/1999 | Baugh et al. | |
| 5,960,881 | A | 10/1999 | Allamon et al. | |
| 6,142,226 | A | 11/2000 | Vick | |
| 6,182,752 | B1 | 2/2001 | Smith, Jr. et al. | |
| 6,390,200 | B1 | 5/2002 | Allamon et al. | |
| 6,575,238 | B1 | 6/2003 | Yokley | |
| 6,672,384 | B2 | 1/2004 | Pedersen et al. | |
| 6,904,970 | B2 | 6/2005 | Simson | |
| 7,032,668 | B2 * | 4/2006 | Mondelli et al. | 166/291 |
| 7,066,249 | B2 | 6/2006 | Simson | |
| 2008/0149336 | A1 * | 6/2008 | Szarka et al. | 166/291 |

* cited by examiner

*Primary Examiner* — Shane Bomar
*Assistant Examiner* — James G Sayre
(74) *Attorney, Agent, or Firm* — Garvey, Smith, Nehrbass & North, L.L.C.; Charles C. Garvey, Jr.; Vanessa M. D'Souza

(57) ABSTRACT

An improved method and apparatus for catching and holding a ball, plug or dart during oil and gas well operations (e.g., cementing operations) employs a specially configured tool body that accepts a ball or a plug or a dart that flows downwardly into the tool body but disallows escape or discharge of the ball, plug or dart upwardly. The tool body has first and second flow channels or passages, one being generally axially aligned with the tool body. The other flow channel or passage is a second channel or passage that enables fluid flow around a cavity that contains one or more captive plugs (or ball or dart(s)).

22 Claims, 5 Drawing Sheets

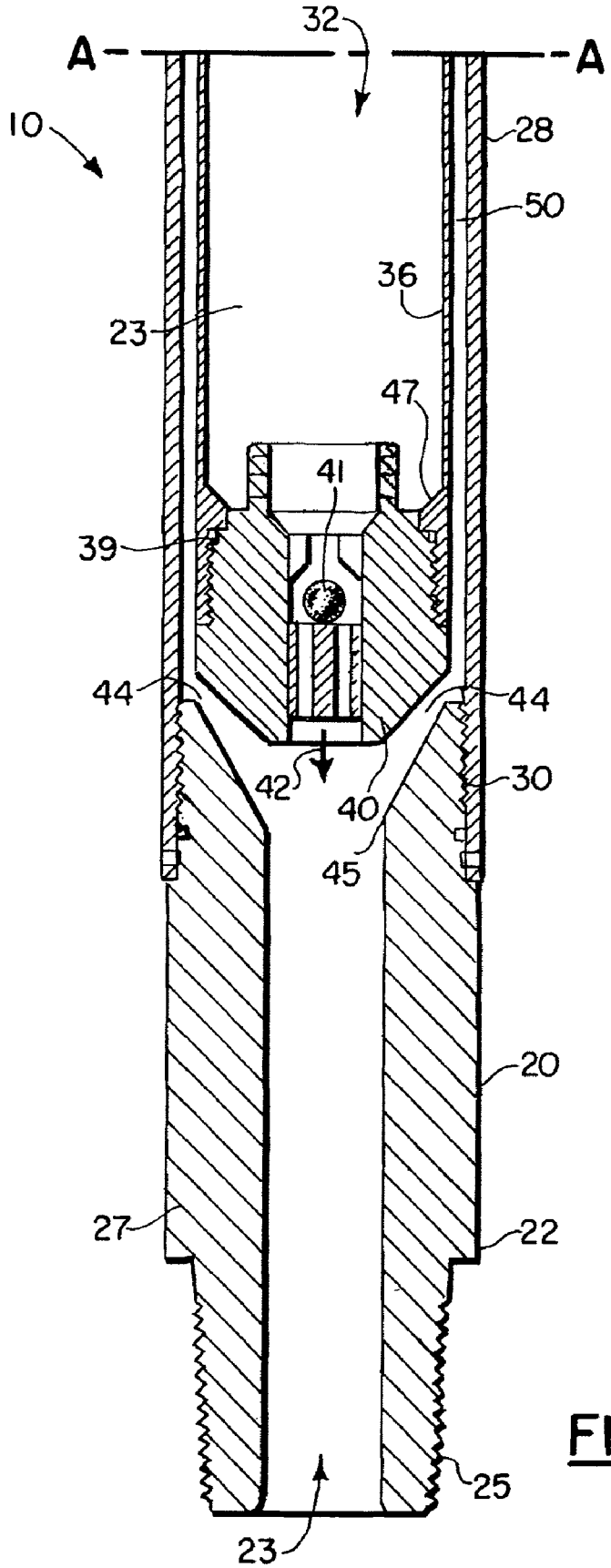
FIG. IB.

METHOD AND APPARATUS FOR CATCHING A PUMP-DOWN PLUG OR BALL

CROSS-REFERENCE TO RELATED APPLICATIONS

Priority of U.S. Provisional Patent Application Ser. No. 60/948,057, filed Jul. 5, 2007, incorporated herein by reference, is hereby claimed.

STATEMENT REGARDING FEDERALLY SPONSORED RESEARCH OR DEVELOPMENT

Not applicable

REFERENCE TO A "MICROFICHE APPENDIX"

Not applicable

BACKGROUND OF THE INVENTION

1. Field of the Invention

The present invention relates to a method and apparatus that is of particular utility in cementing operations associated with oil and gas well exploration and production. More specifically the present invention provides an improvement to cementing operations and related operations employing a plug or ball dropping head.

2. General Background of the Invention

Patents have issued that relate generally to the concept of using a plug, dart or a ball that is dispensed or dropped into the well or "down hole" during oil and gas well drilling and production operations, especially when conducting cementing operations. The following possibly relevant patents are incorporated herein by reference. The patents are listed numerically. The order of such listing does not have any significance.

TABLE

| U.S. PAT. NO. | TITLE | ISSUE DATE |
|---|---|---|
| 3,828,852 | Apparatus for Cementing Well Bore Casing | August 1974 |
| 4,427,065 | Cementing Plug Container and Method of Use Thereof | January 1984 |
| 4,624,312 | Remote Cementing Plug Launching System | November 1986 |
| 4,671,353 | Apparatus for Releasing a Cementing Plug | June 1987 |
| 4,722,389 | Well Bore Servicing Arrangement | February 1988 |
| 4,782,894 | Cementing Plug Container with Remote Control System | November 1988 |
| 4,854,383 | Manifold Arrangement for use with a Top Drive Power Unit | August 1989 |
| 4,995,457 | Lift-Through Head and Swivel | February 1991 |
| 5,095,988 | Plug Injection Method and Apparatus | March 1992 |
| 5,236,035 | Swivel Cementing Head with Manifold Assembly | August 1993 |
| 5,293,933 | Swivel Cementing Head with Manifold Assembly Having Remove Control Valves and Plug Release Plungers | March 1994 |
| 5,435,390 | Remote Control for a Plug-Dropping Head | July 1995 |
| 5,758,726 | Ball Drop Head With Rotating Rings | June 1998 |
| 5,833,002 | Remote Control Plug-Dropping Head | November 1998 |
| 5,856,790 | Remote Control for a Plug-Dropping Head | January 1999 |
| 5,960,881 | Downhole Surge Pressure Reduction System and Method of Use | October 1999 |
| 6,142,226 | Hydraulic Setting Tool | November 2000 |

TABLE-continued

| U.S. PAT. NO. | TITLE | ISSUE DATE |
|---|---|---|
| 6,182,752 | Multi-Port Cementing Head | February 2001 |
| 6,390,200 | Drop Ball Sub and System of Use | May 2002 |
| 6,575,238 | Ball and Plug Dropping Head | June 2003 |

BRIEF SUMMARY OF THE INVENTION

The present invention provides an improved method and apparatus for use in cementing and like operations, employing an apparatus that catches and retains a plug or ball dropping head, preventing inadvertent discharge or escape of the plug.

BRIEF DESCRIPTION OF THE SEVERAL VIEWS OF THE DRAWINGS

For a further understanding of the nature, objects, and advantages of the present invention, reference should be had to the following detailed description, read in conjunction with the following drawings, wherein like reference numerals denote like elements and wherein:

FIGS. 1A-1B are sectional elevation views of the preferred embodiment of the apparatus of the present invention and wherein line A-A are match lines;

DETAILED DESCRIPTION OF THE INVENTION

Figure 1A:
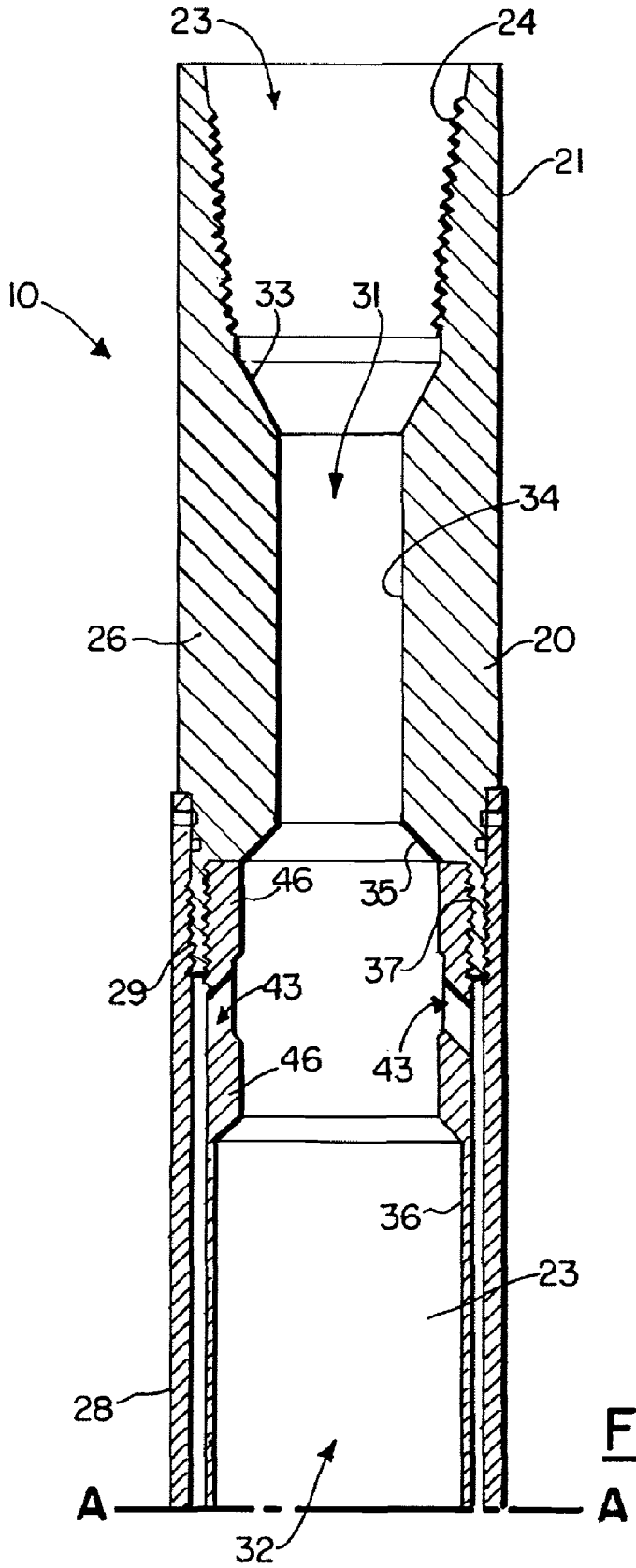
Figure 2:
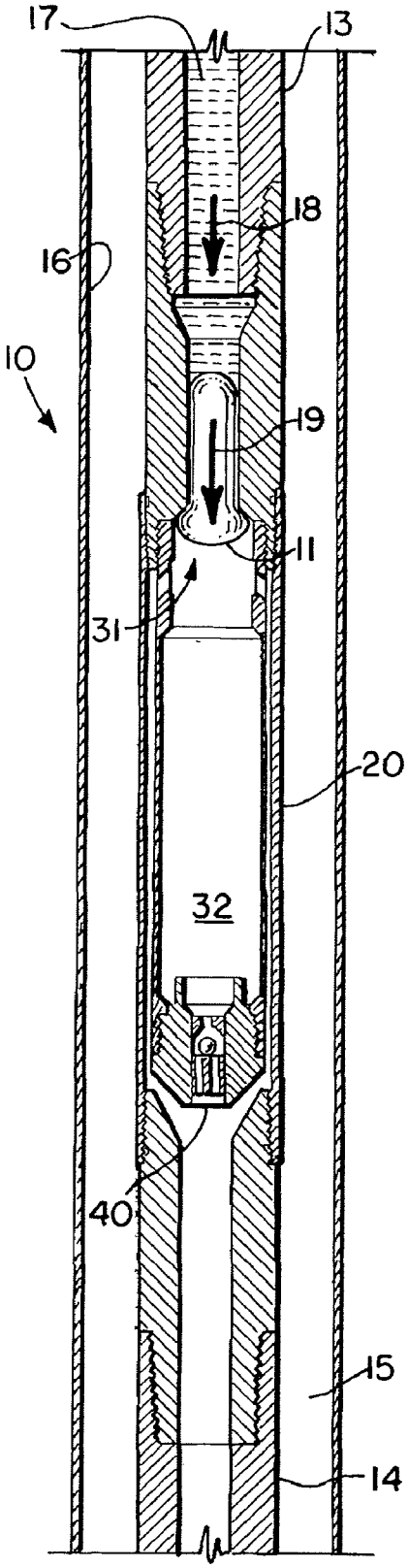
FIG. 2 is a sectional, elevation view of the preferred embodiment of the apparatus of the present invention and showing the method of the present invention.
Figure 3:
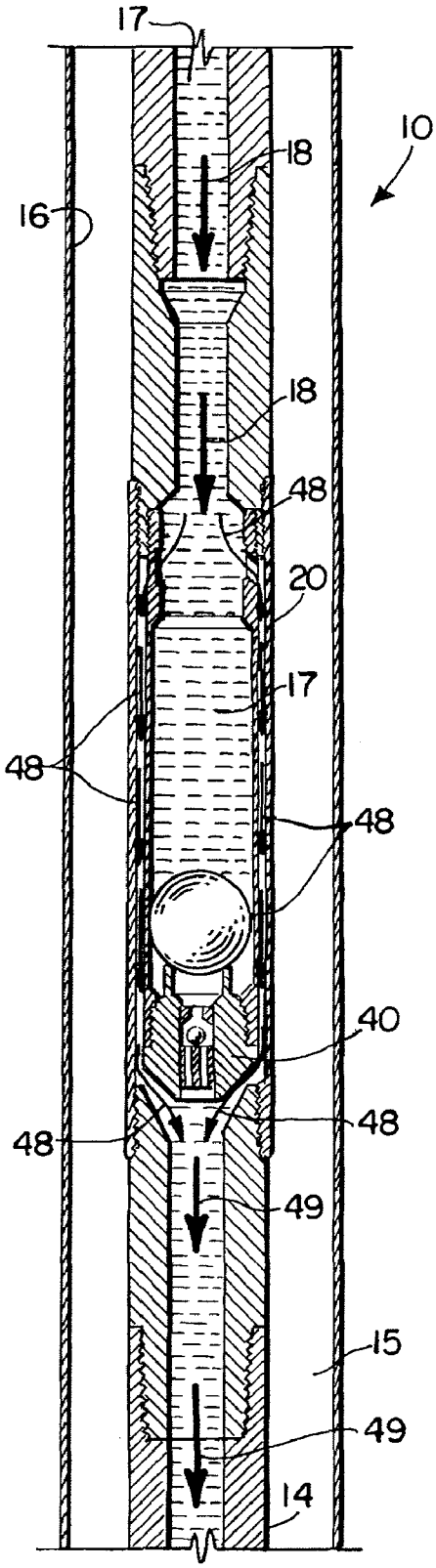
FIG. 3 is a sectional, elevation view of the preferred embodiment of the apparatus of the present invention and showing the method of the present invention.
Figure 4:
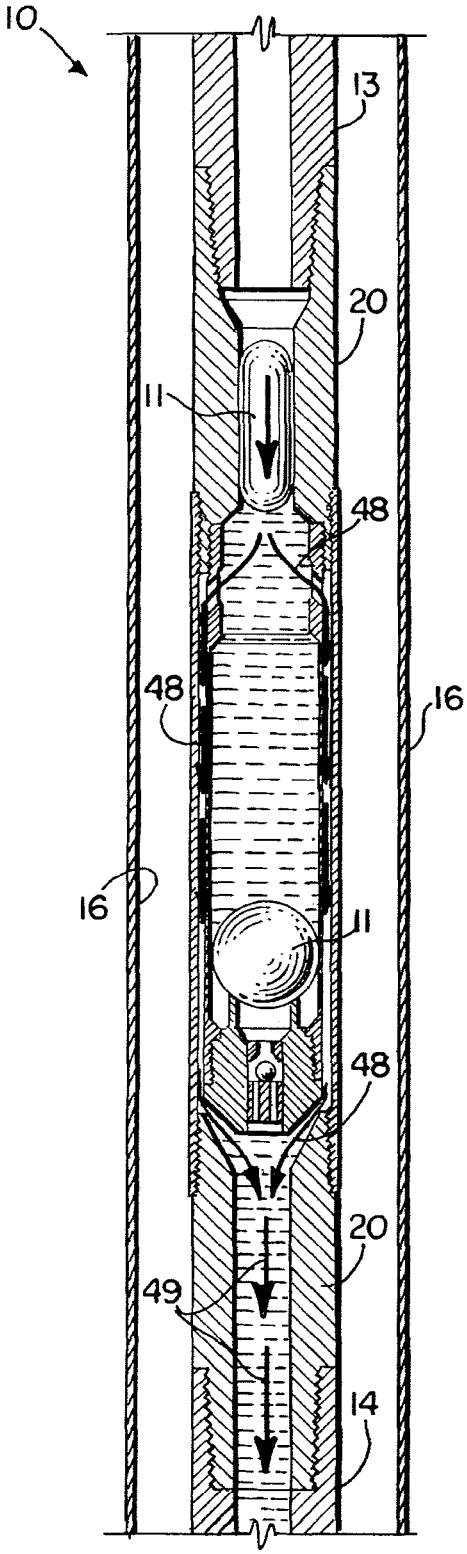
FIG. 4 is a sectional, elevation view of the preferred embodiment of the apparatus of the present invention and showing the method of the present invention.
Figure 5:
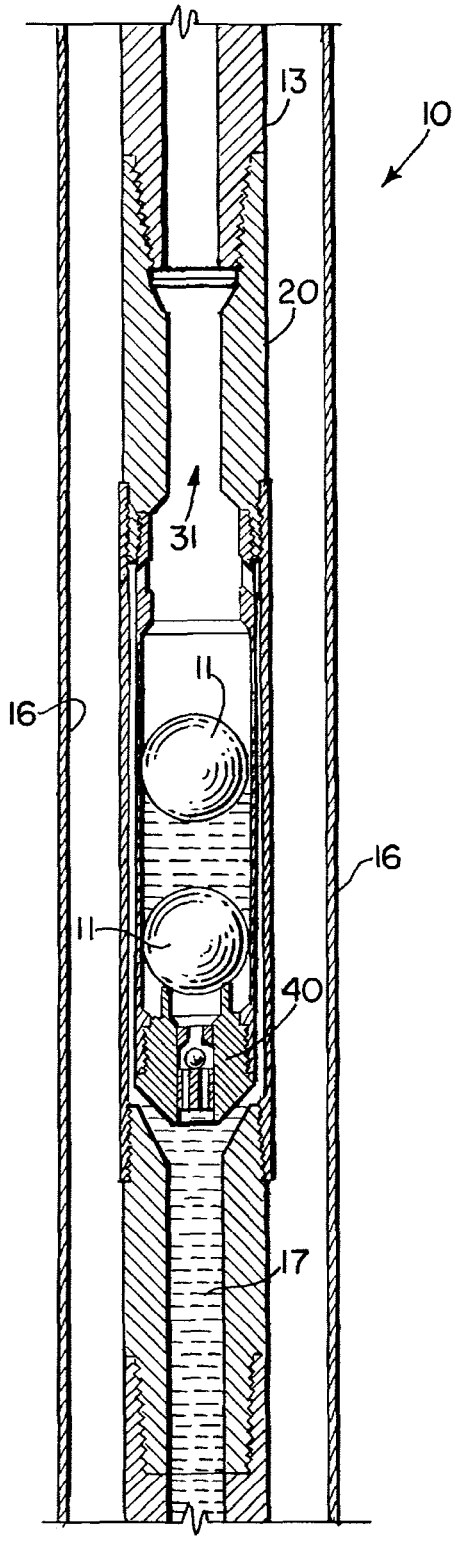
FIG. 5 is a sectional, elevation view of the preferred embodiment of the apparatus of the present invention and showing the method of the present invention.
Figure 6:
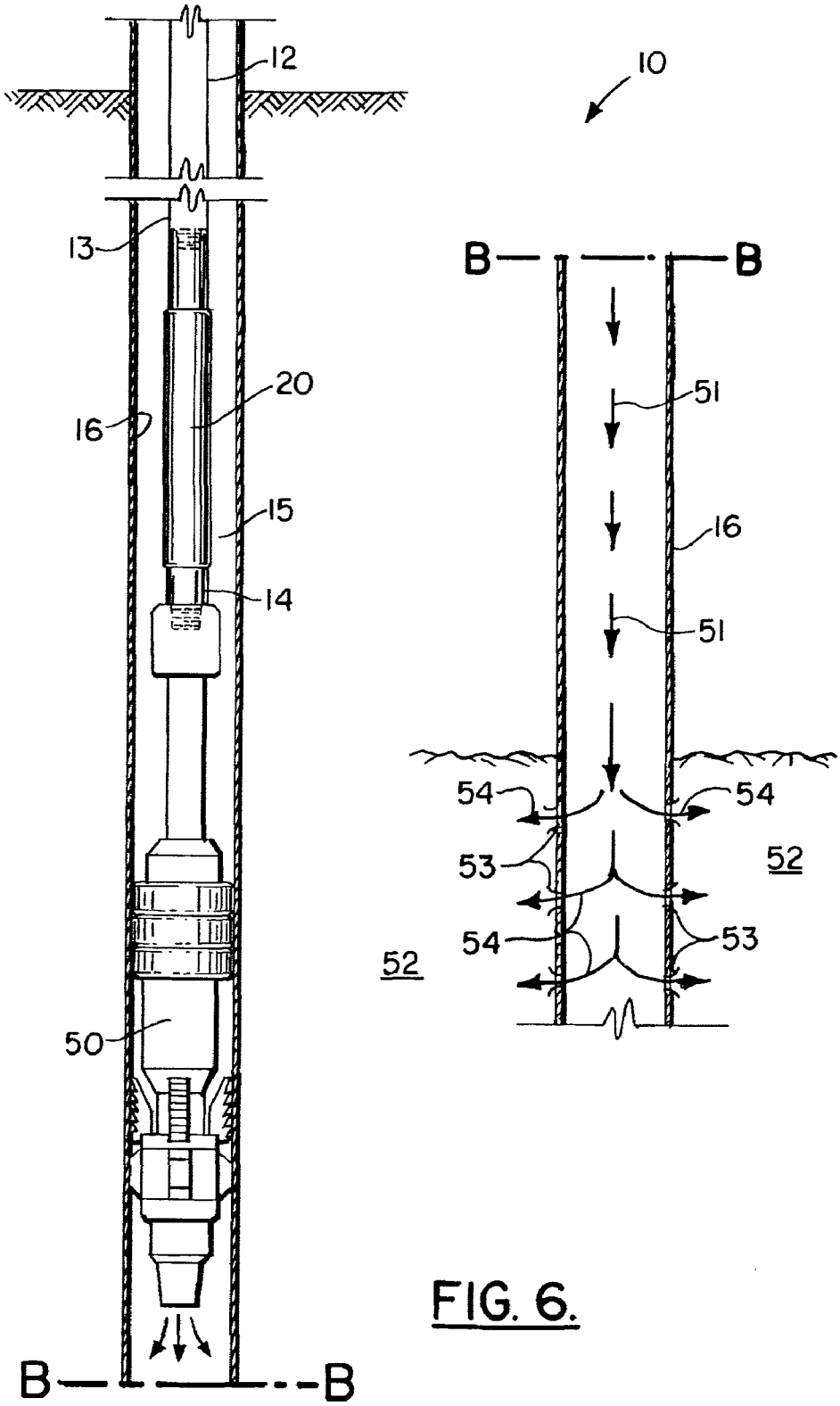
FIG. 6 is a sectional view of the preferred embodiment of the apparatus of the present invention and showing the method of the present invention wherein lines B-B are match lines.

FIGS. 1-6 show generally the preferred embodiment of the apparatus of the present invention designated generally by the numeral 10. The downhole tool 10 of the present invention is used to catch and retain one or more plugs, balls or darts 11 that have been used as part of a cementing operation or other downhole oil well operation. The present invention could be applied to any operation that requires separation of fluid in an oil and gas well environment. Any severely deviated hole where the top and bottom of the cement needs to be defined accurately would typically require plugs.

The downhole tool 10 of the present invention provides a tool body 20 having an upper end portion 21 and a lower end portion 22. A main flow bore 23 or first channel extends substantially the length of tool body 20. The bore or channel 23 can be open-ended as shown in FIG. 1. Tool body 20 is typically mounted in a well string or work string 12 or pipe string, being attached to joints of pipe 13, 14 and lowered into the well bore 15. Well bore 15 can be lined with casing 16 or other known liner. Joint 13 of string 12 connects to tool body 20 at upper end portion 21. Joint 14 of string 12 connects to tool body 20 at lower end portion 22. The tool body 20 thus provides at its upper end portion 21 an internally threaded section 24 for enabling attachment to the joint of pipe 12 that is above tool body 20. Similarly, the lower end portion 22 of tool body 20 provides an externally threaded section 25 for enabling it to be attached to the joint of pipe 14 that extends below tool body 20.

Tool body 20 can be a multi section tool body as shown in FIGS. 1A-1B. The tool body 20 thus can provide an upper tool body section 26, a lower tool body section 27 and a central tool body section 28. These tool body sections 26, 27, 28 can be assembled together using threaded connections for example. In FIGS. 1A-1B, a threaded connection 29 can be used for joining upper tool body section 26 to central tool body section 28. Similarly, a threaded connection 30 can be used for joining lower tool body section 27 to central tool body section 28.

Upper tool body section 26 provides a restriction or a smaller diameter bore section 31 as shown. Below the restriction or smaller diameter bore section 31 is provided a larger diameter bore section 32 that is adapted to hold and retain one or more plugs, balls, or darts 11 as shown. Thus, the internal diameter of larger diameter section 32 can be about the same as the external diameter of the ball, plug or dart 11 to be contained.

A tapered surface 33 is provided on upper tool body section 26 immediately below internally threaded section 24. A generally cylindrically shaped surface 34 is provided below tapered surface 33. Another tapered surface 35 is provided below the generally cylindrically shaped surface 34.

Sleeve 36 extends downwardly from upper tool body section 26 as shown in FIGS. 1A-1B. Sleeve 36 can be attached to upper tool body section 26 using a threaded connection 37. The sleeve 36 can be a generally cylindrically shaped sleeve that is concentrically placed inside of the central tool body section 28 as shown in FIGS. 1A-1B.

Sleeve 36 provides an upper enlarged portion 46 having one or more flow ports 43. Sleeve 36 also provides a lower enlarged portion 47. Check valve 40 is attached to the tool body 20 and can be attached to the lower enlarged portion 47 of sleeve 36. An O-ring 39 can be provided as a seal in between sleeve 36 and check valve 40. Check valve 40 provides a valving member 41. Valving member 41 only allows flow in the direction of arrow 42. Check valve 40 can be a commercially available check valve such as is sold under the trademark Conbraco, such as a Series 61 stainless steel ball-cone type check valve.

Flow ports 44 extend between second channel 50 and first channel 23 at a position below larger diameter section 32 of first channel 23 and preferably below check valve 40. Thus, fluid flow can circumvent the balls, plugs or darts 11 that are contained within the larger diameter section 32 or first channel 23. Flow through second channel 50 thus begins in first channel 23 at a position near restriction 31. Flow then circumvents the plug, ball, dart 11 by passing from first channel 23 via ports 43 to second channel 50 and then downwardly in second channel 50 to ports 54 which are in the lower end portion 22 of tool body 20 (see FIGS. 3-5). From ports 44, flow again enters first channel 23 at a position that is next to tapered surface 45 and generally below lower enlarged portion or below check valve 40.

During use, one or more plugs, balls, darts 11 are used in a downhole oil well environment as part of a cementing operation. These plugs, balls, darts 11 are typically used to provide a well-defined front and rear to a volume of cement 17 that is pumped down hole as indicated schematically by arrows 18 in FIGS. 2-5. Thus, the first ball, dart or plug 11 can be put in front of the volume of cement 17 while a second plug, ball or dart 11 is placed above or at the rear of volume of cement 17. When the ball, plug or dart 11 that is in front of the volume of cement reaches restriction 31, it can be pumped through the restriction 31 by increasing pressure behind it, forcing it to deform and pass through the restriction 31 (see arrow 19 in FIG. 2). Such plugs, balls, darts 11 are typically of a deformable material such as a rubber material, an elastomeric material, a polymeric material or the like. Once inside the larger diameter section 32 of bore 23, the ball, plug or dart 11 has a memory and it regains its original shape (see FIG. 3).

From its position within enlarged diameter section 32 (FIG. 3), only an increase of pressure from a position below the ball or dart or plug 11 can force it upwardly back through the restriction 31. However, check valve 40 prevents such a rearward or upward flow of pressurized fluid. Because the ball, plug or dart 11 blocks the flow of cement downwardly in the main bore 23, it circumvents the tool body 20 by traveling in the second channel 50. Cement 17 is able to bypass section 32 by entering ports 43, then channel 50, and then ports 44 until it is below check valve 40 (see arrows 48, FIGS. 3-4) and can exit the tool body 20 in the direction of arrows 49.

The volume of cement 17 can then be pumped to and below packer 51 via perforations 53 in casing 16 and into producing formation 52, as indicated by arrows 54. Packer 51 is commercially available and/or known in the art.

The following is a list of parts and materials suitable for use in the present invention.

PARTS LIST

| Part Number | Description |
|---|---|
| 10 | down hole tool |
| 11 | plug/ball/dart |
| 12 | well string/work string |
| 13 | joint of pipe |
| 14 | joint of pipe |
| 15 | well bore |
| 16 | casing |
| 17 | volume of cement |
| 18 | arrow |
| 19 | arrow |
| 20 | tool body |
| 21 | upper end portion |
| 22 | lower end portion |
| 23 | flow bore/first channel |
| 24 | internally threaded section |
| 25 | externally threaded section |
| 26 | upper tool body section |
| 27 | lower tool body section |
| 28 | central tool body section |
| 29 | threaded connection |
| 30 | threaded connection |
| 31 | restriction/smaller diameter section |
| 32 | larger diameter section |
| 33 | tapered surface |
| 34 | cylindrically shaped surface |
| 35 | tapered surface |
| 36 | sleeve |
| 37 | threaded connection |
| 38 | tapered surface |
| 39 | O-ring |
| 40 | check valve |
| 41 | valving member |
| 42 | arrow |
| 43 | flow port |
| 44 | flow port |
| 45 | tapered surface |
| 46 | upper enlarged portion |
| 47 | lower enlarged portion |
| 48 | arrow |
| 49 | arrow |

-continued

PARTS LIST

| Part Number | Description |
|---|---|
| 50 | second channel |
| 51 | packer |
| 52 | formation |
| 53 | perforation |
| 54 | arrow |

All measurements disclosed herein are at standard temperature and pressure, at sea level on Earth, unless indicated otherwise.

The foregoing embodiments are presented by way of example only; the scope of the present invention is to be limited only by the following claims.

The invention claimed is:

1. A method of catching plugs in a down hole oil well environment, comprising the steps of:

a) providing a tool body having upper and lower end portions, an annular tool body wall, a bore that provides a first flow channel and that is surrounded by the tool body wall, the bore having a restriction at the upper end portion of the tool body of smaller diameter and a central section of larger diameter that is larger than said smaller diameter, and a check valve at the lower end portion of the tool body that closes the bore;

b) providing a second flow channel that begins at a position next to the upper end portion of the tool body and that extends downwardly to a position below the check valve, a portion of said second channel being in the tool body annular tool body wall externally of said central section;

c) enabling flow in a downward flow direction via the second flow channel;

d) enabling flow in a downward flow direction via the first flow channel;

e) transmitting a plug to the tool body via a well string until the plug is in the central, larger diameter section of the bore; and f) preventing removal of the plug from the bore by using the check valve of step "a" to disallow upward flow in the first channel.

2. The method of claim 1 wherein step "b" includes the second channel being positioned above the central, larger diameter section of the bore.

3. The method of claim 1 wherein step "b" includes the second channel being positioned to communicate with a flow inlet that is above the central, larger diameter section of the bore.

4. The method of claim 1 wherein step "b" includes the second channel being positioned to communicate with a flow inlet that is positioned next to the restriction.

5. The method of claim 1 wherein step "b" includes the second channel being positioned to communicate with a flow inlet that is positioned below the restriction.

6. The method of claim 1 wherein step "b" includes the second channel being positioned to communicate with a position that is below the central, larger diameter section of the bore.

7. The method of claim 1 wherein step "b" includes the second channel being positioned to communicate with a flow outlet that is below the central, larger diameter section of the bore.

8. The method of claim 1 wherein step "b" includes the second channel being positioned to communicate with a flow outlet that is below the check valve.

9. The method of claim 1 wherein step "b" includes the second channel being positioned to communicate with a flow outlet that is positioned next to the check valve.

10. The method of claim 1 wherein in step "a" a sleeve is removably connectable to the tool body, the sleeve communicating with the bore.

11. The method of claim 10 wherein in step "a" the sleeve is positioned in between the restriction and the check valve.

12. The method of claim 1 wherein in step "a" the tool body is of multiple tool body sections.

13. The method of claim 12 wherein in step "a" some of the tool body sections are threadably connected together.

14. The method of claim 12 wherein in step "a" the tool body sections include an upper tool body section, a lower tool body section and a central tool body section.

15. The method of claim 14 wherein in step "a" the restriction is on the upper tool body section.

16. The method of claim 14 wherein in step "a" the upper tool body section has a sleeve connected to it inwardly of the central tool body section.

17. The method of claim 16 wherein in step "b" the second flow channel passes in between the central tool body section and the sleeve.

18. The method of claim 16 wherein in step "a" the check valve is attached to the sleeve.

19. The method of claim 1 wherein the first and second flow channels are in fluid communication above at a position near the upper end portion of the tool body.

20. The method of claim 1 wherein the first and second flow channels are in fluid communication above at a position near the lower end portion of the tool body.

21. The method of claim 1 wherein in steps "a" and "b" the first flow channel has a diagonally extending port that extends to the second flow channel at a position near the upper end portion of the tool body.

22. The method of claim 1 wherein in steps "a" and "b" the first flow channel has a diagonally extending port that extends to the second flow channel at a position near the lower end portion of the tool body.

* * * * *